United States Patent [19]

Kessler

[11] 4,226,050

[45] Oct. 7, 1980

[54] ANTI-LEAKAGE WINDOW FRAME CONSTRUCTION FOR TILT-IN WINDOW SASH

[76] Inventor: Gerald Kessler, Box 389, McClurg Rd. at Southern Blvd., Youngstown, Ohio 44512

[21] Appl. No.: 9,061

[22] Filed: Feb. 2, 1979

[51] Int. Cl.[2] ..... E05D 15/22

[52] U.S. Cl. ..... 49/181; 49/453

[58] Field of Search ..... 49/181, 445, 453

[56] References Cited

U.S. PATENT DOCUMENTS

| | | | |
|---|---|---|---|
| 3,500,586 | 3/1970 | Johnson | 49/445 X |
| 3,611,636 | 10/1971 | Trout | 49/181 |
| 3,676,956 | 7/1972 | Taylor et al. | 49/181 X |
| 3,959,926 | 1/1976 | Noecker et al. | 49/181 |
| 4,144,674 | 3/1979 | Dovman | 49/181 X |

*Primary Examiner*—Kenneth Downey

*Attorney, Agent, or Firm*—Browdy and Neimark

[57] ABSTRACT

A tilt-in window assembly of the type wherein the sash is conventionally held only at the top and bottom between extruded window frame side rails, previously allowing the sash to be bowed inwardly by heavy wind forces. The extruded window frame is now provided at its side rails with protrusions extending for the entire height of the frame. The sash has side flanges which cooperate with the side rail protrusions to limit the inward bowing of the sash so as to prevent the sash weather-stripping from disengaging from its normal sealing contact surfaces, thereby preventing external air from passing by the weather-strippping.

8 Claims, 6 Drawing Figures

ANTI-LEAKAGE WINDOW FRAME CONSTRUCTION FOR TILT-IN WINDOW SASH

FIELD OF THE INVENTION

This invention relates to tiltable window constructions, and more particularly to a window construction for tiltable double hung windows which prevents excessive bowing of the window sash under external wind forces and thereby prevents leakage of air past the associated weather-stripping.

BACKGROUND OF THE INVENTION

In typical windows of the tilt-in type, exemplified in U.S. Pat. No. 3,959,926 to M. V. Noecker et al and U.S. Pat. No. 3,861,082 to M. L. Dau, the sliding sash members are pivotally slidably retained in the associated window frame side rails at their bottom ends and are slidably retained in the side rails at their top ends by retractable bolt elements. The side portions of the sash are provided with weather-strips which normally sealingly engage against vertical flange elements on the associated frame side rails. When the sash, whose framing portions are usually made of extruded aluminum, plastic, or other relatively flexible material, is subjected to heavy external wind forces, the sash tends to bow inwardly at its center portion, and this inward distortion is frequently of sufficient magnitude to cause the associated weather-stripping to disengage from the said rail flange elements, thereby allowing leakage of air past the weather-stripping; this is a particularly severe problem with PVC. Sometimes such heavy external wind forces can even cause permanent distortion of the sash. This undesirable contingency may occur either where the weather-stripping is carried by the sliding sash members and normally engages the stationary side rails of the associated window frame, or in the reverse situation where the weather-stripping is mounted on the stationary window frame side rails and normally engages the sliding sash members. In either case there is a need for controlling and limiting the bowing of the sash members under heavy wind forces.

A preliminary search of the prior art reveals the following U.S. Pat. Nos. of interest:

Hagerty et al, 2,763,038
Livsey et al, 2,933,777
Dau, 3,861,082
Noecker et al, 3,959,926
Wolfe, 4,087,941

SUMMARY OF THE INVENTION

Accordingly, a main object of the present invention is to provide an improved sliding sash window construction which overcomes the defects and deficiencies of the previously-employed tiltable-sash window constructions.

A further object of the invention is to provide an improved window construction of the tiltable sliding sash type which is not subject to air leakage-causing distortion under heavy external wind forces.

Another object is to overcome defects in the prior art, such as noted above, and at a very low cost.

A still further object of the invention is to provide an improved window construction of the type employing sliding sash members which are pivotally slidably retained in a window frame at one end and are lockingly slidably retained in said frame at the other end, and which employ weather-stripping elements at their sides, the improved construction having anti-bowing means to prevent the leakage of air past the weather-stripping elements under heavy external wind forces.

A still further object of the invention is to provide an improved tiltable-sash window construction of the type employing extruded relatively flexible sash side elements retained only at their top and bottom portions, the construction having novel and improved means to limit the bowing of the sash under heavy external wind forces, whereby to prevent air leakage past the weather-stripping between the sash and the side rail members of the associated window frame.

A still further object of the invention is to provide an improved tilt-in sliding sash window construction wherein the window frame is provided with sash distortion-preventing means extending continuously along the side rails of the frame and cooperating with side flanges on the sash to prevent excessive bowing of the sash under heavy external wind forces, thereby preventing air leakage past the weather-stripping at the respective sides of the sash.

BRIEF DESCRIPTION OF THE DRAWINGS

Further objects and advantages of the invention will become apparent from the following description and claims, and from the accompanying drawings, wherein:

DESCRIPTION OF PREFERRED EMBODIMENTS

Figure 2:
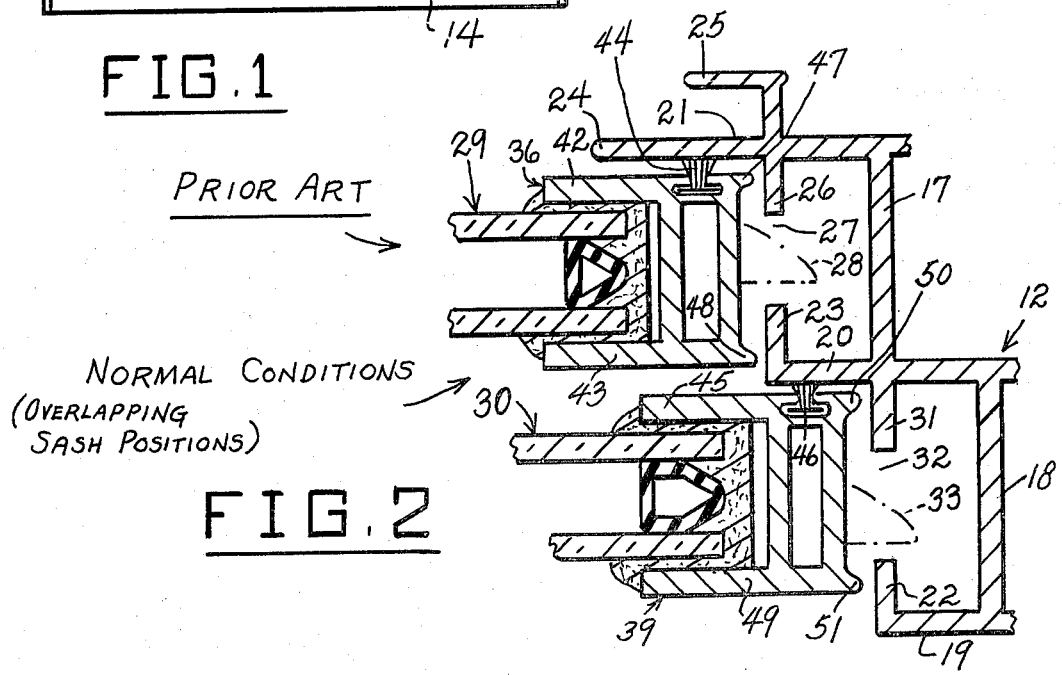
FIG. 2 is a fragmentary enlarged horizontal cross-sectional view taken through a side portion of the conventional window assembly of FIG. 1, with the sash members thereof in overlapping positions, and showing the prior-art arrangement of weather-stripping cooperating with parts of the associated window frame side rail.

Referring to the drawings, a conventional window frame 11 for double-hung, double insulated glass windows, for example similar to that disclosed in U.S. Pat. No. 3,959,926 to M. V. Noecker et al, comprises stiles or side rails 12 and 13, together with a sill 14 and a header 15. The side rails 12 and 13 may be fabricated in any suitable manner, for example, may comprise extruded aluminum, extruded plastic e.g. PVC, or other suitable material. The side rail 12 may thus comprise a stepped side plate including sections 17 and 18 with an inside flange 19, a middle flange 20 and an outside flange 21, as shown in FIG. 2. The inside flange 19 has a contact flange 22 at its free end extending perpendicularly to the plane of the window. The middle flange 20 has a similar contact flange 23 extending perpendicularly to the plane of the window at its free end, while the outside flange 21 has a contact portion 24 extending parallel to the plane of the window. A flange 25 extends from a projection of section 17 and is parallel with outside flange 21.

Flange 21 has an inwardly extending contact flange element 26 coplanar with flange 23 and spaced therefrom to define a slot 27 adapted to slidably receive the retractile top sash-retaining bolt shown in broken line view at 28, and also to receive a bottom sliding sash pivot member associated with the top sash 29 of the window assembly, as described in said U.S. Pat. No. 3,959,926.

The left side rail or stile 13 is symmetrically similar in structure to the above-described right side rail or stile 12. As can be readily seen in FIGS. 2 and 3, the contact flanges 23 and 26, together with the contact portion 24, form a generally L-shaped channel for the top sash 29, which channel is open on the inside and closed by the contact portion 24, or leg of the L 24, on the outside. Similarly, the middle flange 20 and contact flanges 31 and 22 form a generally L-shaped channel, open at the inside, for a lower sash 30.

The bottom sash 30, is generally similar in construction to the top sash 29. The middle flange 20 has the inwardly extending contact flange 31 coplanar with contact flange 22 and is spaced therefrom to define a vertical slot 32 to slidably receive the retractile top bolt 33 and also to receive a bottom sliding sash pivot member associated with the bottom sash 30, such as described in U.S. Pat. No. 3,959,926 or otherwise known. The left side structure associated with bottom sash 30 is symmetrically similar to the illustrated right side sash structure.

Bolt-retraction handles 34, 34 and 35, 35 are respectively provided for the top sash 29 and bottom sash 30, e.g. as described in U.S. Pat. No. 3,959,926, for retracting the retaining bolts 28 and 33 to permit pivoting and/or removal of the sash units 29 and 30.

Figure 1:
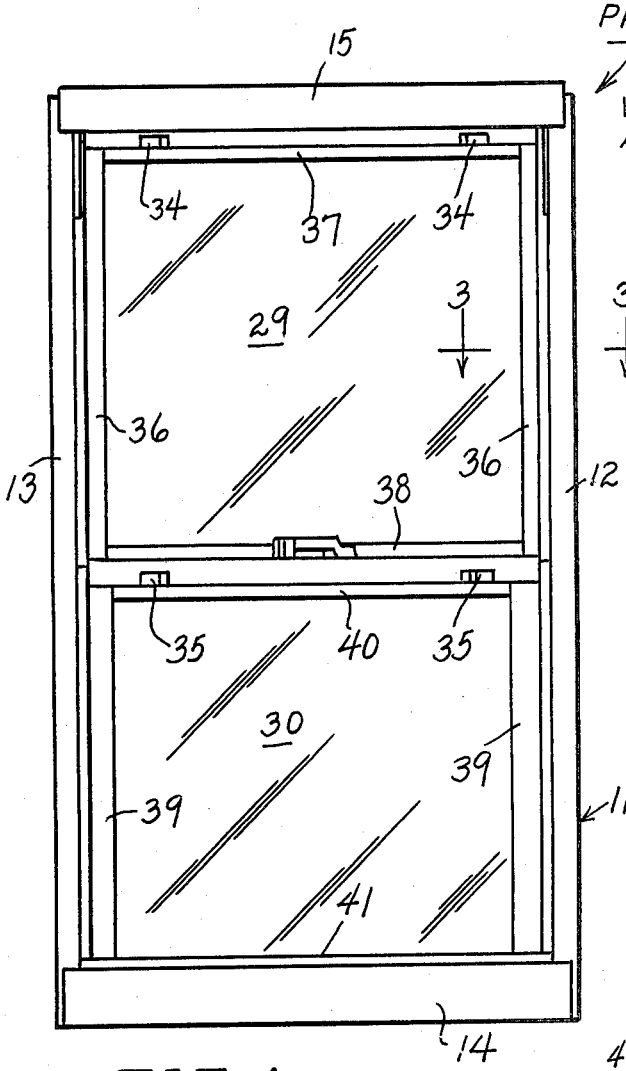
FIG. 1 is an elevational view, from inside, of a conventional window assembly of the titalable sash type, as known in the prior art.

As shown in FIG. 1, top sash member 29 is provided with vertical side frame members 36, 36 and top and bottom horizontal frame members 37, 38. Similarly, bottom sash member 30 is provided with vertical side frame members 39, 39 and horizontal top and bottom frame members 40, 41. Side frame members 36 are generally channel-shaped and included channel walls 42, 43. Each wall 42 normally extends parallel to and is adjacent to a stationary contact flange 24 and is provided with a continuous weather-strip element 44 normally in substantially sealing contact with the adjacent contact flange 24. Similarly, the side frame elements 39 of bottom sash 30 are generally channel-shaped and have channel walls 45 adjacent to and parallel with middle flanges 20 and are provided with continuous weather-strip elements 46 normally in substantially sealing contact with said flanges 20.

The channel walls 42, 43 have end flanges 47, 48 respectively extending adjacent to the stationary coplanar flange elements 26 and 23. Similarly, the channel walls 45 and 49 of lower sash 30 have end flanges 50, 51 respectively extending adjacent to the stationary flange elements 31 and 22, as shown in FIG. 2.

Figure 3:
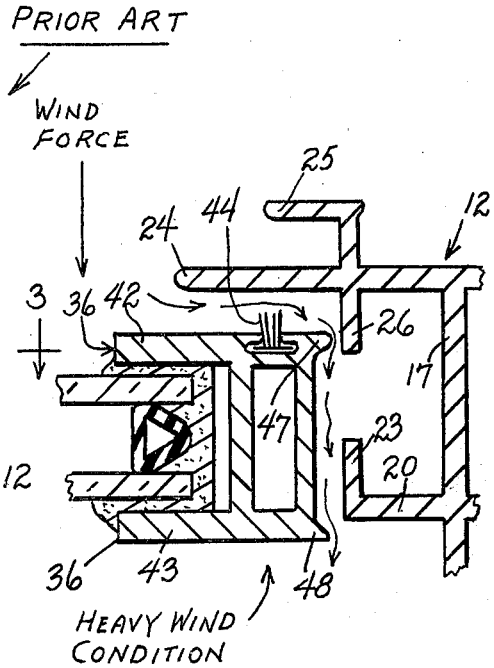
FIG. 3 is a fragmentary enlarged horizontal cross-sectional view taken substantially on line 3—3 of FIG. 1 and showing the sash bowed inwardly under wind forces and illustrating the air leakage past the weather-stripping which occurs under these conditions with the prior art construction.

The side frame members 36, 36 and 39, 39 comprise extruded aluminum, extruded plastic material (such as polyvinyl chloride), or other suitable material. These side frame members are relatively flexible, and consequently, as they are normally held in the L-shaped channels of the side rails only at their top and bottom ends, the sash members 29 and 30, when in closed positions as shown in FIG. 1, tend to bow toward the inside responsive to heavy wind conditions, the wind forces causing the sash members to deflect inwardly by substantial amounts, particularly at their intermediate portions, as shown in FIG. 3. This causes the weather-strip elements 44 and 46 to disengage from the stationary contact flange elements 24 and 20 and provide air leakage paths to allow external air under external wind pressure to flow past the weather-strip elements, namely, to flow past the weather-strips and the channel wall end flanges 47, 48 and 50, 51. This causes drafts, heat loss, or other undesirable air leakage effects under heavy external wind conditions.

In accordance with the present invention, substantially positive stop means are provided to limit the inward deflection of the sash members and to thereby improve the air-sealing of the sash members under external wind conditions, both by preventing disengagement of the weather-strip elements from their cooperating stationary contact surfaces and by providing auxiliary surface-to-surface contact between the sash members and their associated side rails under such external wind conditions.

Figure 4:
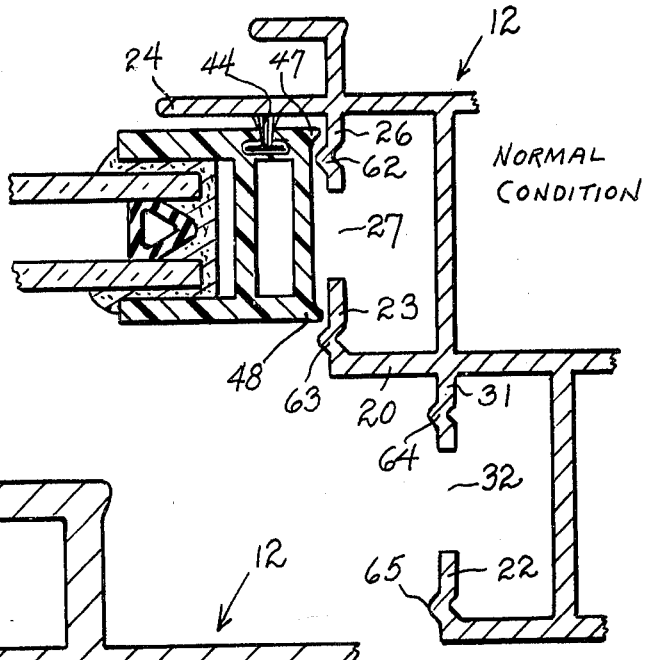
FIG. 4 is an enlarged horizontal cross-sectional view generally similar to FIG. 3, showing an improved window construction according to the present invention, shown in a normal condition.
Figure 5:
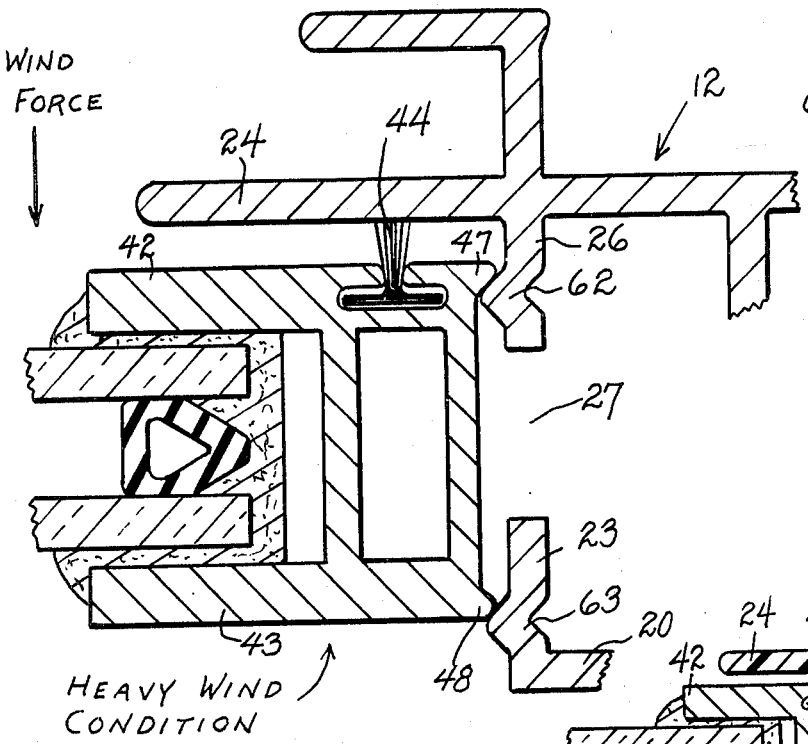
FIG. 5 is a further enlarged fragmentary horizontal cross-sectional view generally similar to FIG. 4 but showing the cooperation of the parts, according to the present invention, for retaining the weather-stripping in sealing position under heavy external wind forces.

Referring to FIGS. 4 and 5, in accordance with the present invention the guide slot-defining opposing coplanar flanges or legs 26, 23 and 31, 32 are formed with respective vertical protrusions in the form of continuous corrugation-shaped ribs 62, 63 and 64, 65 extending into the paths of inward movement of the respective pairs of end flange elements 47, 48 and 50, 51. Under heavy external wind conditions tending to cause inward bowing of the sash members, the end flange elements 47, 48, 50, 51 engage the ribs and limit the inward bowing action sufficiently to prevent disengagement of the weather-strip members 44, 46 from their associated stationary cooperating sealing surface members 24 and 20. Also, there is a substantial amount of cooperative surface contact between flange elements 47, 48 and ribs 62, 63 and between flange elements 50, 51 and ribs 64, 65 under these deflection-limiting conditions.

Figure 6:
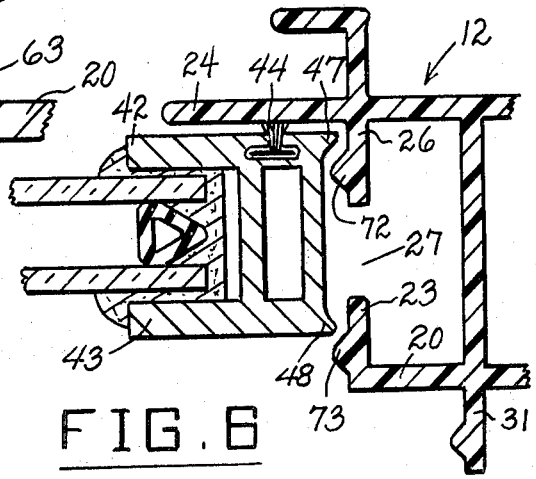
FIG. 6 is a fragmentary horizontal cross-sectional view generally similar to FIG. 4, but showing a modification of the improved window air leakage-preventing structure according to the present invention.

FIG. 6 illustrates an alternative embodiment wherein the guide slot-defining opposing flanges or legs are formed with respective protrusions in the form of continuous vertical solid ribs instead of corrugation ribs. Thus, in FIG. 6 the opposing coplanar flanges 26, 23 are formed with continuous solid vertical ribs 72, 73 extending into the paths of movement of the sash end flange elements 47, 48, providing the same deflection-limiting and auxiliary distributed bearing surface action as is obtained with the continuous vertical corrugation ribs employed in FIGS. 4 and 5. As with the ribs of FIG. 4, the continuous vertical top ribs prevent the disengagement of the weather-trip elements 44, 46 from their cooperating stationary sealing contact surface elements 24 and 30.

The side rails or stiles 12 and 13 are usually aluminum or plastic (such as polyvinyl chloride) extrusions which are substantially rigidly secured to the associated building structure. The opposing coplanar legs 26, 23 and 31, 22 are sufficiently flexible to allow the manual pivoting of the sash members 29, 30 when the sash members are inserted in or removed from the window frame. When the sash members are thus pivoted to or from their vertical retained position, the protrusions, either in the form of continuous corrugations 62, 63 and 64, 65 of FIGS. 4 and 5, or continuous ribs of FIG. 6, deflect the legs 26, 23 and 31, 22 in small changing localized incremental regions, and the legs are sufficiently yieldable to allow this deflection, particularly where the side rails 12, 13 are polyvinyl chloride or similar plastic extrusions. On the other hand, the engagement of the end flanges 47, 48 and 50, 51 with the protrusions under heavy external wind conditions is substantially an extended surface engagement, and the protrusions therefore exert a distributed bearing surface reaction to the wind forces rather than a localized reaction, such as occurs when the sash members are being manually pivoted to or from their vertical retained positions. The distributed reactive forces exerted by the protrusions therefore will be ordinarily sufficient to prevent the excessive bowing of the sash members under heavy wind conditions, whereas the legs carrying the protrusions are locally sufficiently yieldable to allow required manual pivoting of the sash members. The beveled or rounded tips of the protrusions 62, 63, 64, 65, 72, 73 also facilitate the operation permitting tilting of the sash.

It is to be noted that due to the distributed bearing surfaces provided by the deflection-limiting protrusions, if the wind forces are sufficiently heavy to cause substantial inward bowing of the sash members, the side rails will be likewise inwardly bowed, and the weather-strip elements 44 and 46 will still remain in sealing contact with their cooperating sealing surface elements 24, 20, thereby preventing undesired inward air leakages.

The sash deflection-limiting protrusions, either in the form of vertical corrugation-ribs or solid ribs, are preferably located relatively close to their associated weather-strip members 44, 46, for the most effective anti-leakage action. As the weather-strips are usually quite close to the outer edges of the side frame members of the sash, the location of the protrusions adjacent to the end flanges (47, 48 or 50, 51) will satisfy this requirement. It will be understood that both ribs associated with a sash, e.g. 62, 63 or 64, 65 or 72, 73, need not be present, and accordingly in a preferred embodiment only the ribs 62 and 64 are present.

The corrugation-ribs of FIGS. 4 and 5 can be easily provided by a reshaping tool downstream of the die which forms the extruded side rails. The solid ribs of FIG. 6 can be provided by a relatively minor change in existing dies. The invention therefore has an important advantage in that the improved structure can be obtained at very low cost.

While certain specific embodiments of improved window frame constructions for tilt-in window sash have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. A tilt-in window assembly comprising: a window frame having vertical side rails of generally L-shaped open channel construction, and horizontal top and bottom frame portions; a sash member having a top, bottom and two sides, and slidably pivoted at its sides adjacent the bottom thereof to said side rails, and retractable bolt means holding the sides of said sash near the top thereof to said side rails; said L-shaped channel of each said side rail being open toward the inside of said sash with a first leg of said L extending parallel to said sash along the outside edge of the side of said sash, and a second leg of said L extending parallel to the thickness of said sash; weather-stripping between the outside edge of each side of said sash and the first leg of said L, said weather-stripping extending generally parallel to the second leg of said L and being normally sealingly disposed between the sash side and the first leg of said L; and inter-engageable stop means to limit deflection of said sash member toward the inside and to prevent unsealing of said weather-stripping when the sash member is subjected to heavy external wind forces, said stop means comprising respective projections on the side edge portions of the sash member and on the second leg of said L of each side rail, said projections serving to interengage when the sash member is subjected to heavy winds but the terminal portions of such projections being spaced laterally of the window assembly to permit frictional clearance of said projections when said sash member is tilted.

2. The window assembly of claim 1, and wherein the projection on the second leg of each said side rail comprises a continuous extending vertical protrusion, and the projections on the side edge portions of the sash member comprise respective laterally projecting vertical side edge flanges, whereby the inwardly extending protrusions on the side rails extend into the path of deflection of said side edge flanges when the sash member is bowed by wind forces.

3. The window assembly of claim 1, and wherein said weather-stripping is mounted on the opposite side portions of the sash member and normally substantially sealingly engages with the side rails, and wherein said inter-engageable stop means prevents separation of the weather-stripping from said side rails when the sash member is subjected to said heavy wind forces.

4. The window assembly of claim 1, and wherein said weather-stripping is vertically mounted on the opposite side portions of the sash member, said weather-stripping facing outwardly for contact with the first legs of the Ls which constitute vertical contact flanges slidable and sealingly engaged by the weather-stripping, and wherein said sash member projections comprise vertical opposite edge flanges, and wherein said projection on the second leg of each side rail comprises a protrusion on each side rail projecting in the place of the sash member and toward the sash member engageable by a said edge flange when the sash member is subjected to said heavy wind forces, said protrusion on each side rail having means to facilitate tilting comprising a rounded or beveled terminal edge on said protrusion.

5. The window assembly of claim 4, and wherein said protrusions extend continuously for at least the vertical height of the sash member.

6. The window assembly of claim 5, and wherein said protrusions comprise inwardly projecting vertical corrugations on the side rails extending in the path of bowing deflection of said edge flanges.

7. The window assembly of claim 5, and wherein said protrusions comprise inwardly projecting vertical ribs on the side rails extending in the path of bowing deflection of said edge flanges.

8. The window assembly of claim 1, formed of PVC.

* * * * *